US006129586A

United States Patent [19]

Bellemon

[11] Patent Number: 6,129,586

[45] Date of Patent: Oct. 10, 2000

[54] ELECTRICAL CONNECTOR FOR HIGH FREQUENCIES

[75] Inventor: Yvan Bellemon, Saint Jeoire en Faucigny, France

[73] Assignee: Societe de Fabrication Industrielle et Mecanique-SOFIM, France

[21] Appl. No.: 09/202,845

[22] PCT Filed: Apr. 15, 1998

[86] PCT No.: PCT/FR98/00756

§ 371 Date: May 27, 1999

§ 102(e) Date: May 27, 1999

[87] PCT Pub. No.: WO98/48488

PCT Pub. Date: Oct. 29, 1998

[30] Foreign Application Priority Data

Apr. 17, 1997 [FR] France ..... 97 04751

[51] Int. Cl.[7] ..... H01R 13/648

[52] U.S. Cl. ..... 439/607; 439/608

[58] Field of Search ..... 439/608, 607, 439/609, 610, 284, 290, 291, 295

[56] References Cited

U.S. PATENT DOCUMENTS

| | | | |
|---|---|---|---|
| 5,447,453 | 9/1995 | Smith et al. | 439/701 |
| 5,509,824 | 4/1996 | Rodrigues et al. | 439/608 |
| 5,538,440 | 7/1996 | Rodrigues et al. | 439/404 |
| 5,593,311 | 1/1997 | Lybrand . | |
| 5,605,469 | 2/1997 | Wellinsky et al. | 439/417 |
| 5,876,248 | 3/1999 | Brunker et al. | 439/608 |

FOREIGN PATENT DOCUMENTS

| | | |
|---|---|---|
| 0562691 | of 0000 | European Pat. Off. . |
| 0693795 | of 0000 | European Pat. Off. . |

*Primary Examiner*—Paula Bradley
*Assistant Examiner*—Ross Gushi
*Attorney, Agent, or Firm*—Blakely Sokoloff Taylor & Zafman

[57] ABSTRACT

An electrical connector for high frequencies, the connector comprising two elements (100, 200) adapted to be engaged by moving in translation, each element (100, 200) comprising a body (110, 210) of electrically insulating material provided with electromagnetic shielding (130, 230) and carrying a plurality of electrical contacts (120–127; 220–227), the connector being characterized by the fact that the shielding (130, 230) of each element comprises a cage-forming portion (132, 232) provided with an internal cross-piece (135, 235) defining cells each housing a pair of contacts (120–127; 220–227), and said shielding (130, 230) forming, when in the assembled position, an electromagnetic join plane extending generally transversely to the direction in which the connector elements (100, 200) are mutually engaged.

18 Claims, 6 Drawing Sheets

ELECTRICAL CONNECTOR FOR HIGH FREQUENCIES

BACKGROUND OF THE INVENTION

1. Field of the Invention

The present invention relates to the field of electrical connectors for high frequencies, typically of the order of or greater than 600 MHz, in particular for local area networks.

2. Background Information

Accompanying FIGS. 1 and 2 respectively constitute a longitudinal section view and a cross-section view of a known electrical connector element for high frequencies, and accompanying FIGS. 3 and 4 are respectively a longitudinal section view and a cross-section view of that known connector in its assembled position.

The known connector shown in FIGS. 1 to 4 comprises two identical elements 10 presenting a hermaphrodite interface which is coupled together by two "mirror" rotations (left-right then bottom-top) followed by insertion along the contact axis.

Each element 10 comprises:

an electrically insulating body 20 which possesses four parallel strips of rectangular section 22, 24, 26, and 28;

shielding 30 constituted by a cast metal piece (e.g. made of zamak) surrounding three faces of each strip;

pairs of contact springs 40 & 41; 42 & 43; 44 & 45; and 46 & 47 of resilient copper alloy, accessible on a fourth face of each strip (the four faces of the strips all face in the same direction relative to the body 20), which contact springs 40–47 pass through the body 20 so as to be accessible from the rear end thereof, at which end they form insulation displacement contacts in association with:

inserter strips 50, 52.

After two elements 10 have been assembled together, the shielding 30 on each of the elements co-operate to form four cells each housing one pair of contacts 41–47, as can be seen in particular in FIG. 4.

More precisely, the known connector shown in accompanying FIGS. 1 to 4 comprises a plug-forming element 10 and a receptacle-forming element 10. Since the interfaces are identical, the distinction between a plug and a receptacle is made by using two outer shells of plastics material which also has internal metallization so as to ensure that shielding is continuous. One of the shells is said to be male and the other female. The two shells are provided with mechanical keying means to prevent them being engaged the wrong way.

Although that known connector has given good service, it is not completely satisfactory.

In particular, it turns out in use that the known connector suffers from significant leakage via the electromagnetic join plane, referenced 62, 60 in FIGS. 1 to 4, corresponding to the longitudinal join plane defined between the shielding 30 of each of the two elements 10.

In addition, the rear interface portion of the known connector suffers from a discontinuity of shielding between the insulation displacement contacts.

Finally, the metallized shells forming parts of that known connector do not provide satisfactory shielding.

Consequently, the "tunnel" effect of the cells is not guaranteed from one end of the connector to the other.

The present invention now has the object of improving known electrical connectors for high frequencies.

SUMMARY OF THE INVENTION

According to the present invention, this object is achieved by an electrical connector for high frequencies, the connector comprising two elements adapted to be engaged by moving in translation, each element comprising a body of electrically insulating material provided with electromagnetic shielding and carrying a plurality of electrical contacts, the connector being characterized by the fact that the shielding of each element comprises a cage-forming portion provided with an internal crosspiece defining cells each housing a pair of contacts, and said shielding forming, when in the assembled position, an electromagnetic join plane extending generally transversely to the direction in which the connector elements are mutually engaged.

BRIEF DESCRIPTION OF THE DRAWINGS

Other characteristics, objects, and advantages of the present invention appear on reading the following detailed description with reference to the accompanying drawings, given by way of non-limiting example, and in which.

DETAILED DESCRIPTION OF THE INVENTION

Figure 1:
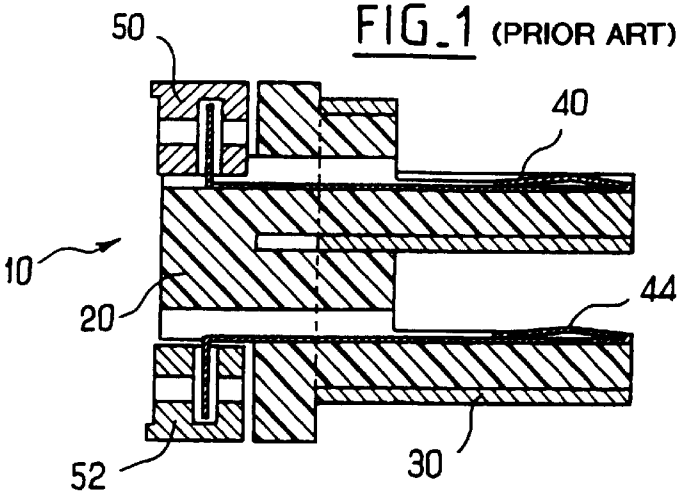
FIG 1 (PRIOR ART)
FIGS. 1 to 4, as described above, show a known electrical connector forming part of the state of the art.
Figure 3:
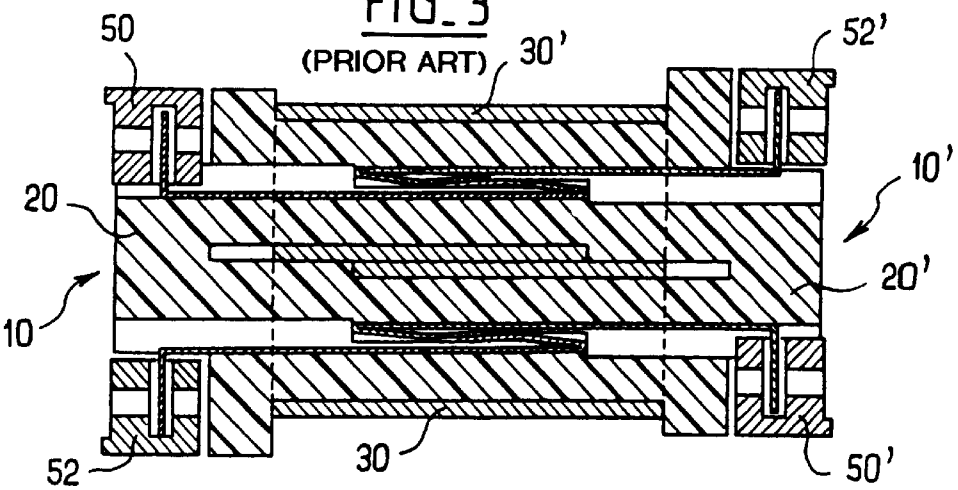
FIG 3 (PRIOR ART)
Figure 2:
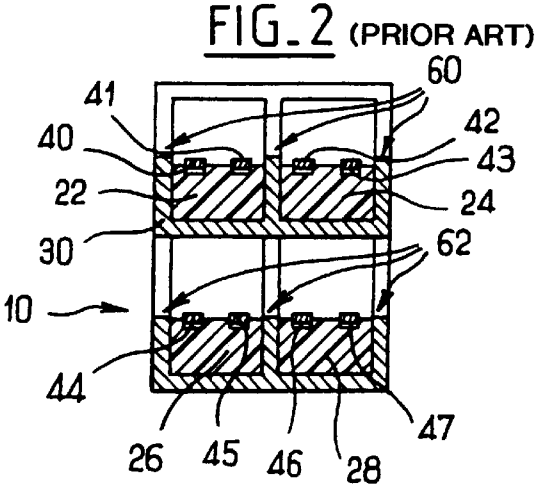
FIG 2 (PRIOR ART)
Figure 4:
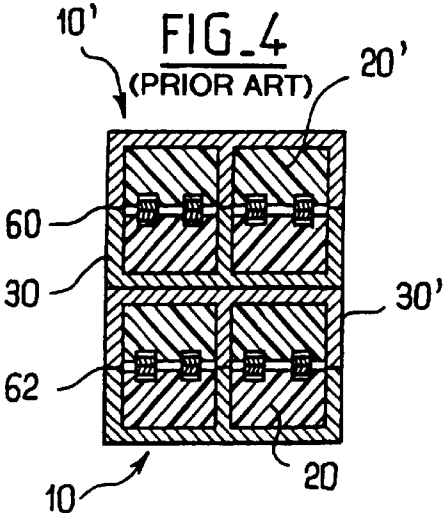
FIG 4 (PRIOR ART)
Figure 6:
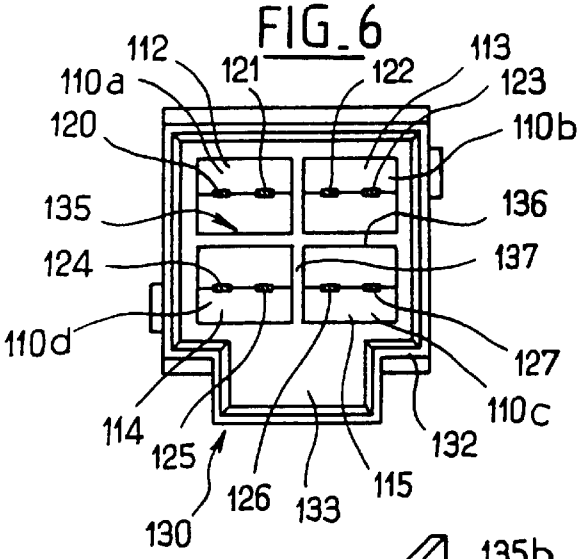
FIGS. 5, 6, and 7 are respectively a longitudinal section view, an end view, and an external side view of a plug-forming element of an electrical connector of the present invention.
Figure 5:
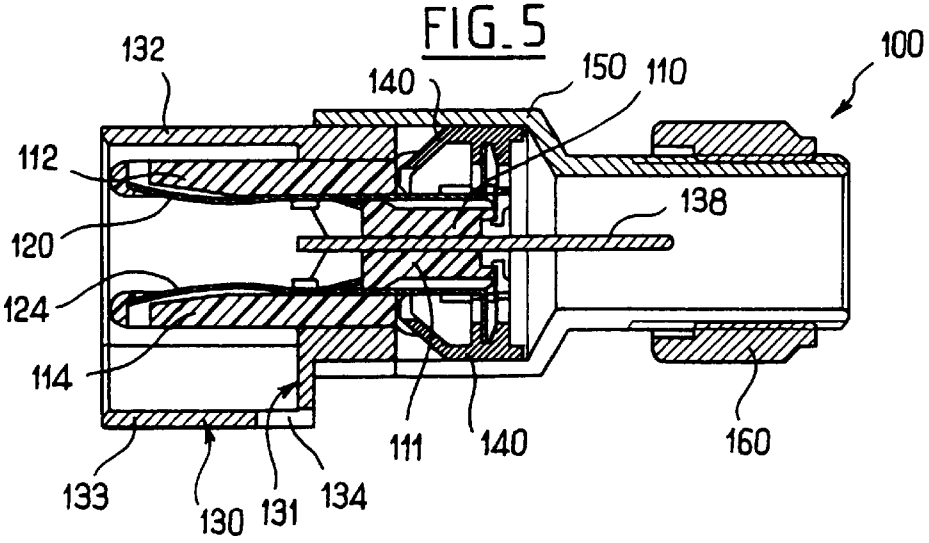
Figure 7:
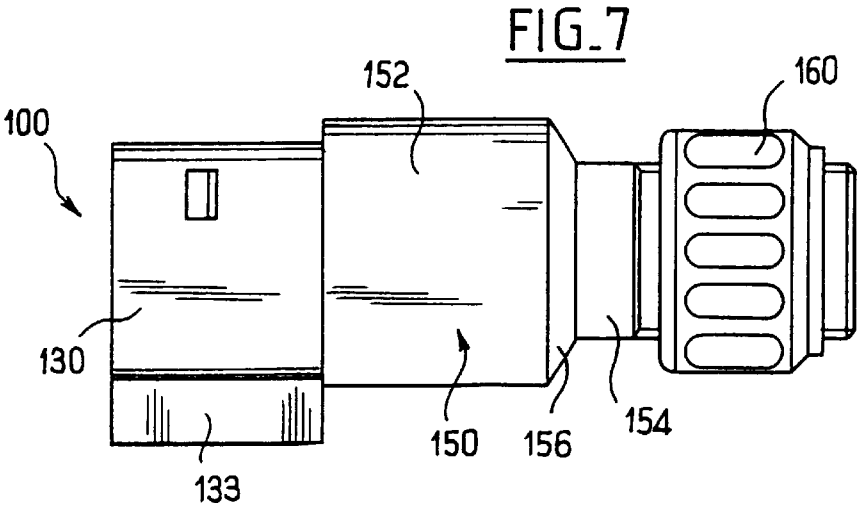

Accompanying FIGS. 5, 6, and 7 show a plug-forming connector element 100 of the present invention.

This element 100 comprises: a body 110 of electrically insulating material, eight contact springs 120, 121, 122, 123, 124, 125, 126, and 127 of electrically conductive material, electromagnetic shielding 130, four inserters 140, a cable clamp 150, and a clamping ring 160.

By way of example, the body 110 can be made by molding an electrically insulating plastics material.

The body 110 is made up of four portions 110*a*, 110*b*, 110*c*, and 110*d* each comprising a rear plate 111 extended forwards by four beams 112, 113, 114, and 115. The beams 112 to 115 are of rectangular section, parallel to one another, and spaced apart equidistantly in pairs. The width/depth ratio of the section of the beams 112 to 115 is typically about 3/1. The zone where the beams 112 to 115 join the rear plates 111 is pierced by eight channels receiving the springs 120 to 127.

These contact springs 120 to 127 can be made of any appropriate electrically-conductive material. The material is preferably gold-plated spring bronze.

The springs 120 to 127 extend in a direction that is generally parallel to the insertion direction when contact is being made.

The springs 120 to 127 are disposed in pairs on the respective beams 112 to 115, and more precisely, as can be seen in FIGS. 5 and 6, on facing parallel faces thereof.

The springs 120 to 127 are preferably curved, being convex towards the midplane of the element 100 parallel to the faces of the beams 112 to 115 that carry the springs 120 to 127. As can be seen in FIG. 5, the leading ends of the springs 120 to 127 can be held by respective recesses formed at the free ends of the beams 112 to 115.

The rear end of each spring 120 to 127 is folded through 90° to form an insulation-displacement contact accessible from the outside of the plates 111 and adapted to co-operate with an inserter 140.

The shielding 130 is made of an electrically conductive material and is preferably cast, e.g. out of zamak. In the embodiment shown in the accompanying figures, the shielding 130 comprises a cage 132 of rectangular right section surrounding the beams 112 to 115 and the springs 120 to 127. The cage 132 has an internal step 131 about two-thirds of the way along its length.

The cage 132 also has a projection 133 on one of its faces. The projection 133 is provided with an opening 134 at its end adjacent to the step 131.

The shielding 130 also has a crosspiece 135 housed in the cage 132. The crosspiece 135 is made up of two mutually orthogonal walls 136 and 137 that touch each other. The two walls 136 and 137 are respectively parallel and orthogonal to the walls of the cage 132. The two walls 136 and 137 are connected to the inside faces of the walls of the cage 132. In the embodiment shown in FIGS. 5 and 6, the front ends of the walls 136 and 137 of the crosspiece are coplanar with each other and coplanar with the step 131. This embodiment thus corresponds with the embodiment shown diagrammatically in FIG. 14.

The springs 120 to 127 and the beams 112 to 115 extend beyond the crosspiece 135, preferably up to the immediate vicinity of the outline at the opening of the cage 132.

In addition, the crosspiece 135 passes through the plate 111 and extends to the rear end thereof in the form of a tail 138 centered on the connector. The tail 138 projects along way behind the plate 111.

The inserters 140 can be mounted to pivot or to move in translation relative to the body 110. In conventional manner, they are adapted to force the electrically conductive portions of an insulated conductor of a cable into the insulation-displacement contact forks formed at the rear end of the contact springs 120 to 127.

The cable clamp 150 is preferably made of metal. It comprises a front endpiece 152 of rectangular right section complementary to the outer envelope of the cage 132 of the shielding. The cable clamp 150 also has a cylindrical rear shank 154 that is split longitudinally over at a portion of its length. The shank 154 is threaded on its outside surface. The link zone between the endpiece 152 and the shank 154 tapers towards the shank.

The ring 160 is internally tapped and adapted to co-operate with the thread on the shank 154 so as to clamp it onto a cable.

Figure 8:
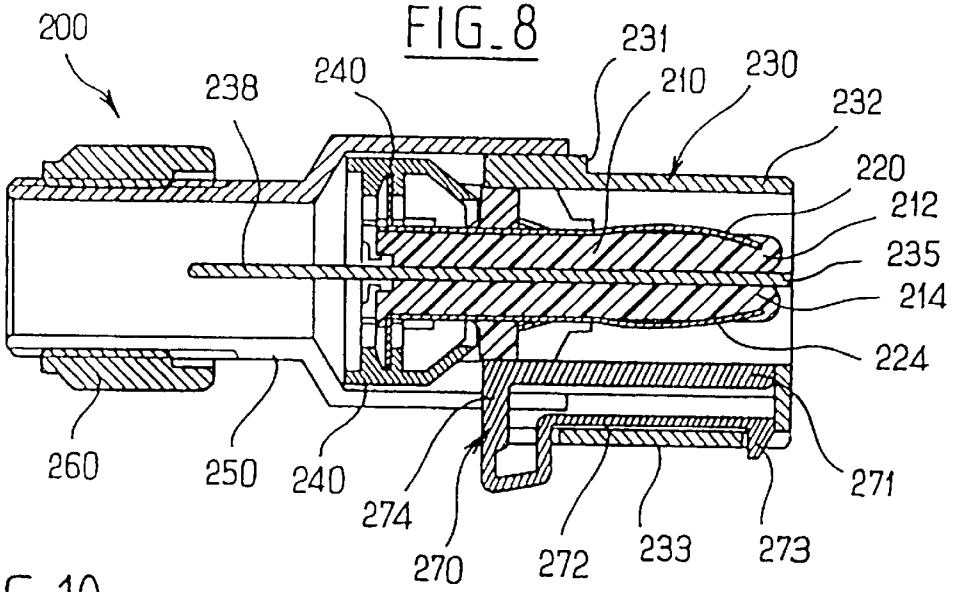
FIGS. 8, 9, and 10 are respectively a longitudinal section view, an end view, and an external side view of a receptacle-forming element of an electrical connector of the present invention.
Figure 10:
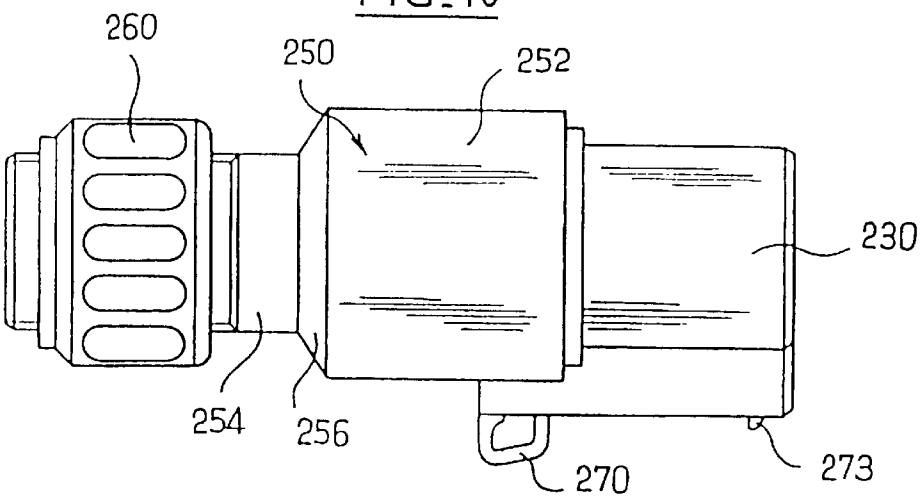
Figure 9:
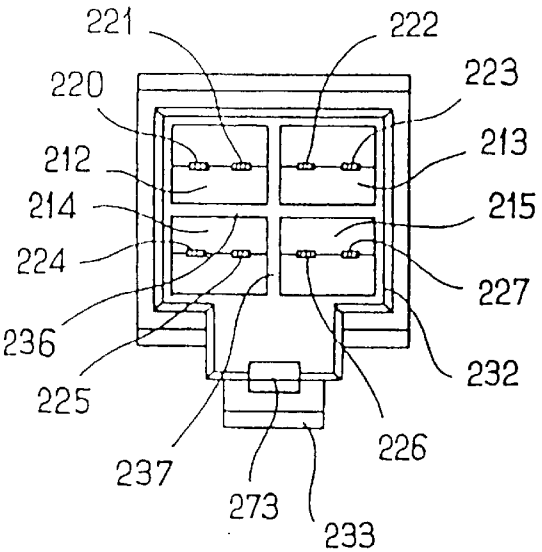

Accompanying FIGS. 8 to 10 show a second element 200 of a receptacle-forming connector of the present invention.

In a manner comparable to the element 100, the element 200 as shown in FIGS. 8 to 10 comprises a body 210 of electrically insulating material, eight contact springs of electrically conductive material 220, 221, 222, 223, 224, 225, 226, and 227, electromagnetic shielding 230, four inserters 240, a cable clamp 250, and a clamping ring 260.

The body 210 is essentially constituted by four beams 212, 213, 214, and 215 of rectangular right section (identical in section to the beams 112–115), that are parallel and equidistant relative to one another. The springs 220 to 227 are preferably made of gold-plated spring bronze. They extend generally parallel to the insertion direction of the connector elements 100 and 200. The contact springs 220 to 227 are placed in pairs on the outside faces of the beams 212, 213, 214, and 215. The springs 220 to 227 are preferably slightly curved, being outwardly convex, i.e. curving away from the midplane parallel to the faces of the beams 212 to 215 carrying them. As can be seen in FIG. 8, the front ends of the springs 222 to 227 are preferably held in the beams 212 to 215.

The rear ends of the springs 220 to 227 are folded through 90° to form insulation displacement contacts that are accessible from outside the body 210 and that are adapted to co-operate with the inserters 240.

The shielding 230 is made of an electrically conductive material, and it is preferably cast, e.g. out of zamak.

The shielding 230 comprises a cage 232 of rectangular right section surrounding the beams 212 to 215 and the springs 220 to 227.

Figure 11:
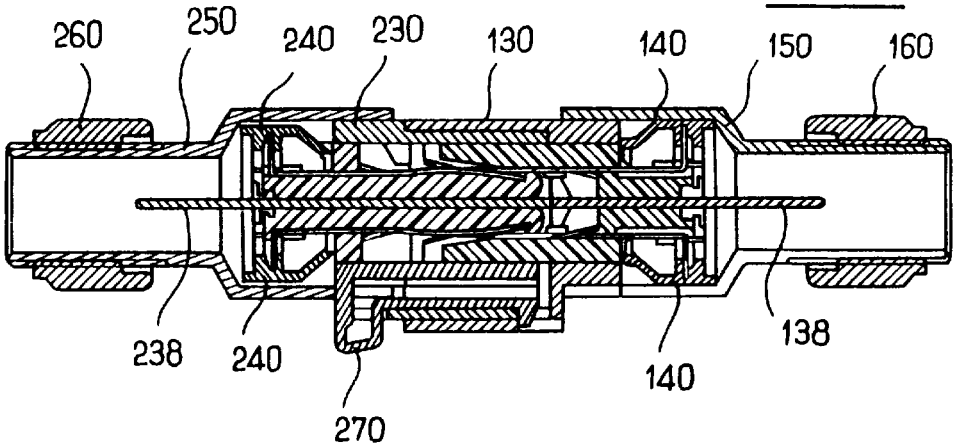
FIG. 11 is a longitudinal section view of the above-mentioned plug element and receptacle element in an assembled position.

The cage 232 is provided with a step 231 on its outside surface. This step 231 is adapted to receive the free end of the cage 232, as can be seen in FIG. 11.

In addition, the cage 232 has a projection 233 on one of its faces, corresponding to the projection 133 on the element 100. This projection 233 is adapted to receive a locking element 270 described in greater detail below.

The shielding 230 also possesses a crosspiece 235 housed in the cage 232. The crosspiece 235 is made up of two touching and mutually orthogonal walls 236 and 237. These walls 236 and 237 are respectively parallel and orthogonal to the walls of the cage 232. They are connected to the inside faces of the walls of the cage 232.

In the embodiment shown in FIGS. 8 and 9, the front ends of the walls 236 and 237 forming the crosspiece 235 are mutually coplanar and they are also coplanar with the outline of the opening of the cage 232.

It will be observed that the shape and the dimensions of the beams 112, 113, 114, and 115 are adapted so that on assembly these beams are received between the outside faces of the beams 212, 213, 214, and 215, the inside faces of the cage 232, and the vertical wall 237 of the crosspiece. Similarly, the cage 232 is received on assembly between the outside faces of the beams 112, 113, 114, and 115 of the cage 132.

For this purpose, the large faces of the beams 212, 213, 214, and 215 opposite from the faces receiving the contact springs 220 to 227, are adjacent to the horizontal midplane 236 of the crosspiece 235. In contrast, the beams 112, 113, 114, and 115 are remote from the middle wall 136 by a distance that is equal to the thickness of height of the beams 212 to 215. The beams 112 to 115 are adjacent via respective small sides to the wall 137 and likewise the beams 212 to 215 are adjacent via respective small sides to the wall 237.

The beams 212 to 215 are adjacent via second small sides to the inside surfaces of the walls of the shielding cage 232. The other walls of the cage 232, orthogonal to the above-mentioned walls, are situated at a distance from the outer surfaces of the beams 212–215 carrying the contact springs 220 to 227, which distance is equal to the thickness of the beams 112 to 115.

The thickness of the walls of the cage 232 is equal to the thickness of the gap that exists between the inside surface of the cage 132 and the beams 112 to 115.

The lengths of the beams and of the crosspieces are such that after assembly the end planes of the crosspieces 135 and 235 are adjacent to each other.

For this purpose, the length between the step 131 and the end of the cage 132 is equal to the length between the step 231 and the end of the cage 232.

In addition, the walls 136, 137 and 236, 237 of the crosspieces are respectively of the same thickness.

Naturally, after assembly, each of the contact springs 120 to 127 of the element 100 comes to rest against one of the contact springs 220 to 227 of the element 200.

In a manner comparable to the element 100, the crosspiece 235 is extended to the rear of the body 210 in the form of a tail 238 centered on the element 200.

The inserters 240, the cable clamp 250, and the ring 260 are similar respectively to the inserters 140, the cable clamp 150, and the ring 160 as described above.

The locking piece 270 placed in the projection 233 is preferably in the form of a U-shaped piece of resilient material. This locking piece 270 comprises a fixed longitudinal base element 271 secured to the shielding 230, a generally parallel locking tongue 272 provided with a tooth 273 at its free end, and a resilient link branch 274. The tooth 273 is adapted to penetrate into the opening 234 on assembly by bending of the link zone 270. To undo the connector, it suffices to press against the zone 270 to retract the tooth 273.

On examining the accompanying figures, and in particular FIG. 11 which shows the connector of the present invention in the assembled position, the person skilled in the art will understand that this connector of the present invention makes it possible to maintain electromagnetic shielding all along each pair with minimum leakage. The connector serves to provide four cells embodied by the crosspieces 135 and 235 going from the electromagnetic join plane at the interface all the way to the connection of the wires in the insulation displacement contacts. Beyond the insulation displacement contacts, the cable takes over individual shielding of each pair level with the crosspiece.

The present invention also makes it possible to optimize shielding by avoiding any crosstalk due to leakage in the electromagnetic join plane.

Figure 14:
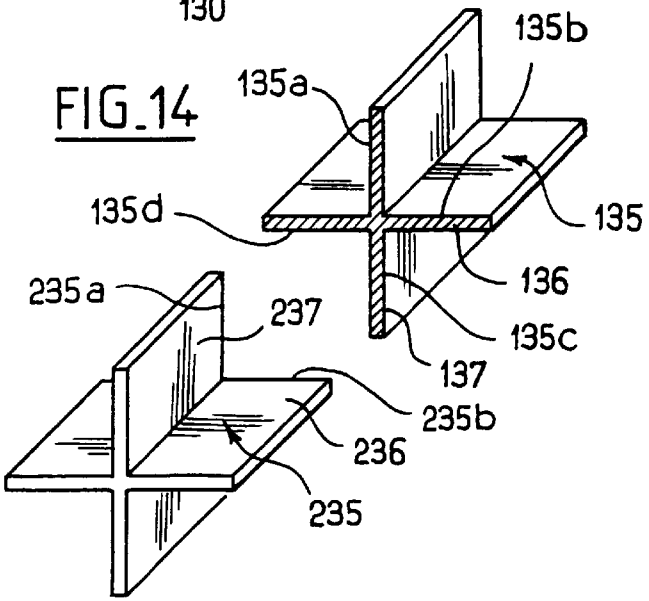
FIGS. 14, 15, and 16 are diagrammatic perspective views of three variant embodiments of the electromagnetic join plane in accordance with the present invention.
Figure 15:
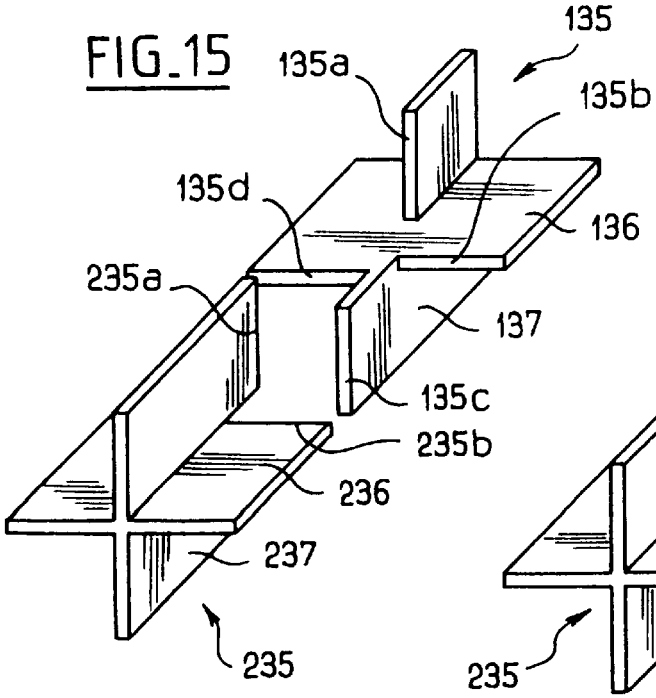
Figure 16:
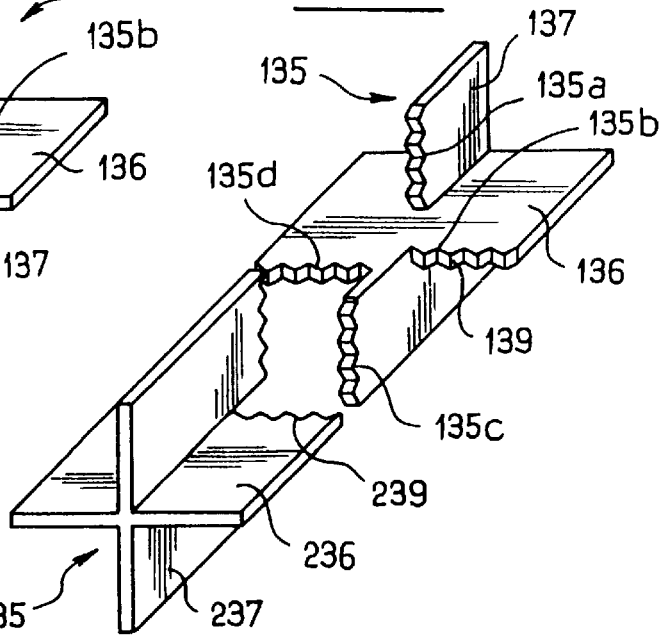

In the description above, the electromagnetic join planes are defined by the free front ends of the crosspieces 135 and 235 which are coplanar and perpendicular to the longitudinal axis of the connector. Such a right electromagnetic join plane intersects the set of cells perpendicularly, as shown diagrammatically in FIG. 14. In FIG. 14, the front ends of the crosspieces 135 and 235 are referenced 135*a*, 135*b*, 135*c*, 135*d*, and 235*a*, 235*b*. In a variant, it is also possible to envisage making the front ends of the walls 136, 137, 236, 237 of the crosspieces 135 and 235 in the form of different segments (135*a–d*, 135*a–b* in FIG. 15) that are not coplanar so as to reduce the risks of crosstalk. By way of example, these may comprise four rectangular segments or join planes perpendicular to the longitudinal axis of the connector, but offset in the longitudinal direction as shown in FIG. 15. The longitudinal offsets between the various segments formed by the front ends of the crosspieces are typically multiples of $\lambda/n$. In another variant shown diagrammatically in FIG. 16, the free front edges of the walls 136, 137 and 236, 237 forming the crosspieces 135, 235 are also provided with serrations 139, 239. Such serrations 139, 239 serve to increase the contact area between the crosspieces 135, 235 and consequently to decrease the transfer impedance and the contact resistance of the ground contact so as to provide better sealing against electromagnetic leaks. Naturally, the shapes of the front ends of the crosspieces 135 and 235 need to be complementary so that regardless of the longitudinal offsets and/or the serrations, the two crosspieces are adjacent.

Shielding at the rear of the connector and transfer to cable ground are provided essentially by the cable clamps 150, 250 which serve to maintain the "tunnel" effect over the insulation displacement contacts by fitting closely over the outsides of the fins or the crosspieces 135, 235, and by mechanically retaining the cable relative to the shielding of the connector as performed by the conical threaded clamping ring 160 or 260 being tightened onto the cable clamp 150 or 250.

The tails 138 and 238 located at the rear ends of the shielding, in the middles of the crosspieces, make it possible to provide contact with the individual shields of each conductor pair.

Figure 12:
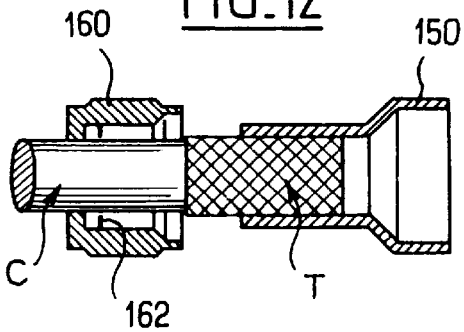
FIGS. 12 and 13 are diagrams of a clamping ring provided with a resilient scraper of the invention adapted for pressing against the ground braid of a cable.
Figure 13:
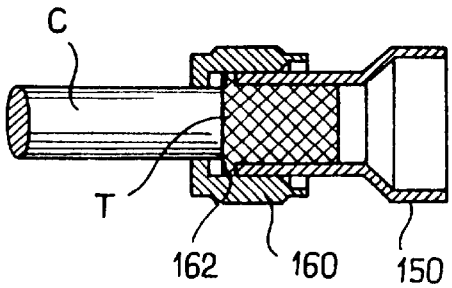

As shown diagrammatically in FIGS. 12 and 13, to improve contact between the shielding formed by the cable clamps 150, 250 and the rings 160, 260, the rings can be provided on their inside faces with resilient scrapers 162. In FIG. 12, a cable C is shown whose front end is surrounded by a ground braid T, together with a cable clamp 150 and a clamping ring 160 provided with a resilient scraper 162.

FIG. 13 shows the same assembly after the clamping ring 160 has been engaged on the cable clamp 150. It can be seen that the braid T is clamped between the resilient scraper 162 and the cable clamp 150.

The receptacle 100 shown in accompanying FIGS. 5 to 7 can be mounted equally well in wall or skirting board supports at access points, or in cross-connection panels in distribution frames. Such a receptacle 100 can be mounted in particular in a box fitted with a tilting front cover piece enabling the box to be closed in the absence of a plug.

To connect a cable to one of the connector elements 100, 200 of the present invention, the following sequence of steps is typically performed:

- the clamping ring 160, 260 is placed in readiness on a cable;
- the outer sheath of the cable is stripped over about 25 mm;
- the braid T of the cable is folded back over the outer sheath thereof;
- the individual screens of the conductor pairs are striped over about 10 mm;
- all of the conductors are carefully laid on the axis of the cable and the rear drain is turned back onto the braid T;
- the cable clamp 150, 250 is slid over the braid T while taking care that the drain lies opposite to the slot in the cable clamp;
- the conductor pairs are inserted in order in the inserters 140, 240;
- the inserters 140, 240 are pushed home until they snap-fasten on bringing the conductors onto the axis of the cable so that the individual shields of the conductors surround the tail 138, 238 of the shielding;
- the cable clamp 150, 250 is moved into position on the connector folded a maximum amount of braid and of drain into the inside thereof; and the clamping ring 160, 260 is tightened until the cable is securely held in place.

Naturally, it is also possible to use a plurality of connector assemblies of the present invention in juxtaposed positions, particularly in skirting board.

The person skilled in the art will understand that the present invention makes on-site connection quick and easy.

Figure 17:
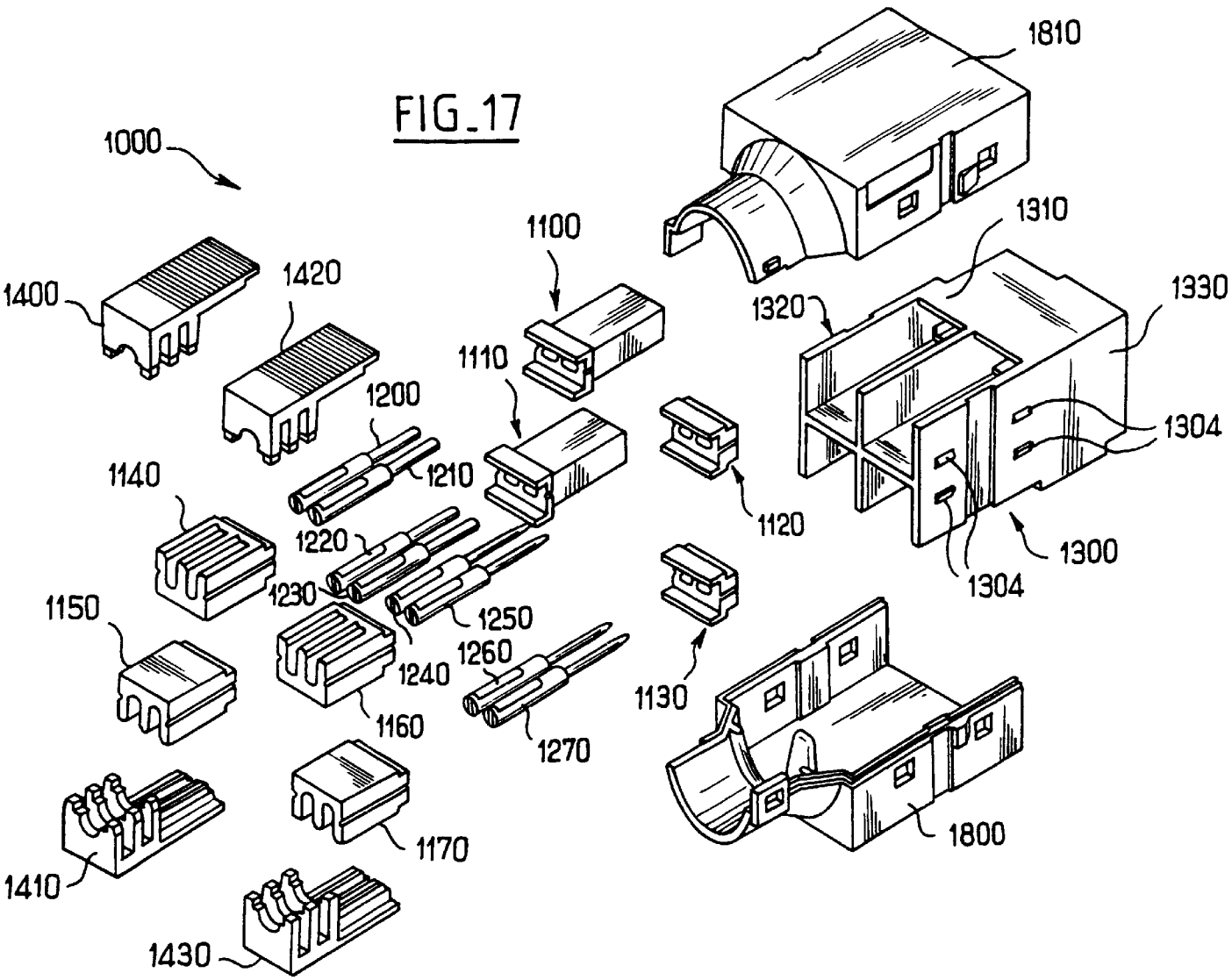
FIG. 17 is a diagrammatic exploded perspective view of a hermaphrodite connector element constituting another variant embodiment of the invention.
Figure 18:
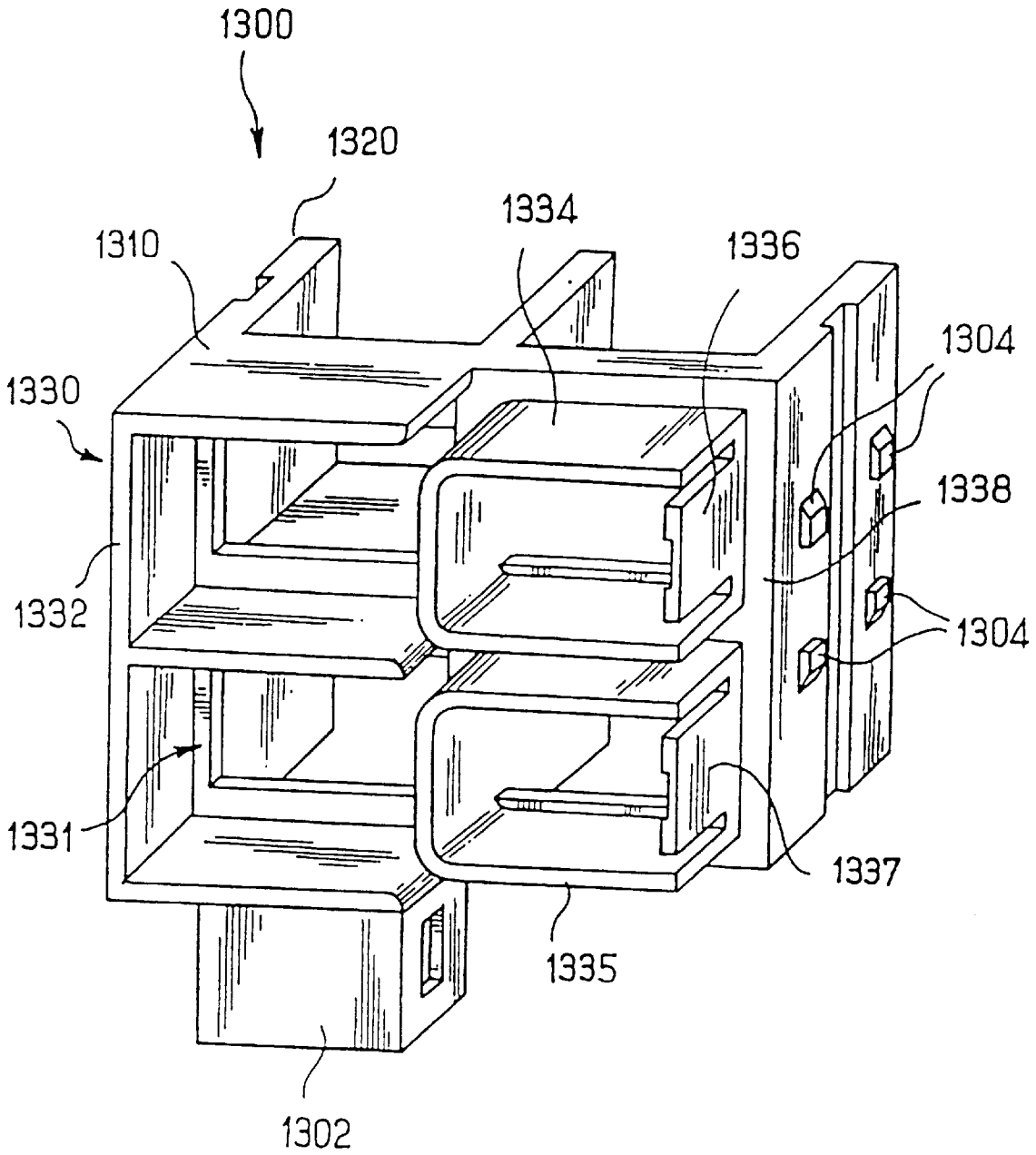
FIG. 18 is a perspective view of the shielding of said connector element constituting this embodiment of the invention.

Accompanying FIGS. 17 and 18 show a hermaphrodite variant embodiment of a connector element 1000 in accordance with the present invention.

In these FIGS. 17 and 18, a connector element 1000 can be seen which mainly comprises:

electrically conductive shielding 1300;

bodies 1100, 1110, 1120, 1130, 1140, 1150, 1160, and 1170 of electrically insulating material which carry:

pairs of contacts 1200, 1210, 1220, 1230, 1240, 1250, 1260, and 1270; and inserters 1400, 1410, 1420, and 1430.

The shielding 1300 can be made by any appropriate means, e.g. by metallizing a box of plastics material or indeed by casting an electrically conductive material, e.g. zamak.

The shielding 1300 has a central portion 1310 having an "8" shape defining four cells of identical rectangular section, designed to receive respective bodies 1100, 1110, 1120, and 1130 of complementary section each carrying a pair of contacts.

The central portion 1310 is extended rearwards by longitudinal sheets 1320 forming a double inverted E-shape sharing a common web. The sheets 1320 extend the walls of the central portion 1310. They thus define four housings that are open laterally towards the outside of the connector, each designed to receive a complementary body 1140, 1150, 1160, and 1170 supporting the contacts, together with an inserter 1400, 1410, 1420, and 1430.

The lateral openings of the housings defined by the sheets 1320 are designed to allow the inserters 1400, 1410, 1420 and 1430 to move as is required to engage the conductors with the contacts 1210 to 1270.

The central portion 1310 of the shielding is also extended forwards by sets of partitions 1330 adapted to interpenetrate with identical sets of partitions of a complementary hermaphrodite connector.

In the particular and non-limiting embodiment shown in FIGS. 17 and 18, these sets of partitions 1330 comprise an E-shaped partition 1332, two U-shaped partitions 1334 and 1335, and two tabs 1336 and 1337.

The E-shaped partition 1332 is open towards a longitudinal midplane of the connector. It thus defines two cells designed to receive respective pairs of male pins 1240 & 1250, and 1260 & 1270. The outside surface of this partition 1332 extends the outside surface of three of the walls of the central portion 1310. However, the partition 1332 is thinner than the thickness of the walls making up the 8-shaped central portion 1310. Thus, in the zone where the partition 1332 connects with the central portion 1310, at the bottoms of the cells formed by said partition 1332, there is formed a step 1331 that is visible in FIG. 18, facing towards the front of the connector, inside the above-mentioned cells, and extending transversely to the direction in which the connector elements engage one another.

The U-shaped partitions 1334 and 1334 have their webs adjacent to the above-mentioned longitudinal midplane, facing the openings in the E-shaped partition 1332. Their U-shapes are thus directed towards the outside of the connector going away from the web of the partition 1332. The tabs 1336 and 1337 are disposed in the openings of these U-shaped partitions 1334 and 1335. The U-shaped partitions 1334 and 1335 thus co-operate with the tabs 1336 and 1337 to define two cells for receiving respective ones of the supports 1100 and 1110, each supporting a pair of female pins 1210 & 1220 and 1230 & 1240. The U-shaped partitions 1334 and 1335 and the tabs 1336 and 1337 are of a thickness that is thinner than the thickness of the walls making up the 8-shaped central portion 1310. Thus, where connection takes place between the U-shaped partitions 1334 and 1335 and the tabs 1336 and 1337 on the central portion 1310, at the bottoms of the cells formed by these U-shaped partitions 1334 and 1335 and by said tabs 1336 and 1337, there is formed a step 1338 visible in FIG. 18 facing towards the front of the connector, located outside the above-mentioned cells, and extending transversely to the direction in which the connector elements are mutually engaged.

The use of tabs 1336 and 1337 that are independent of the partitions 1334 and 1335 makes it possible to use a resilient element suitable for establishing good electrical contact with the shielding element (partition 1332) of the complementary connector element. To this end, and where appropriate, the tabs 1336 and 1337 can be provided with respective projections for resting against said shielding element (partition 1332) of the complementary connector element.

The right sections of the structures defined by the U-shaped partitions 1334 and 1335, and by the tabs 1336 and 1337 is complementary to the right sections of the cells defined by the partition 1332. The width of the step 1331 is identical to the thickness of the partitions 1334, 1335 and of the tabs 1336 and 1337, while the width of the step 1338 is identical to the thickness of the partition 1332. The person skilled in the art will thus understand that the shielding 1300 defines a hermaphrodite connector element enabling the structures defined by the U-shaped partitions 1334, 1335 and the tabs 1336 and 1337 to be inserted into the cells defined by the partition 1332 of a complementary connector element.

Once these connector elements have been mutually engaged, the electromagnetic join plane extending transversely to the engagement direction of the connector elements is defined by the contact plane between the steps 1331, 1338 and the tops of the partitions 1332, 1334, and 1335, and of the tabs 1336 and 1337 placed facing the steps.

To provide keying to prevent wrong connection, the partition 1332 is also provided on the outside surface of one of its side flanges with a projection 1302, e.g. in the form of a rectangular block, which projection is flush with the above-mentioned longitudinal midplane. After assembly, the two projections 1302 of the two connector elements are side by side.

It will also be observed that the shielding 1300 is preferably provided on its outside surface with projecting teeth 1304 designed to secure box-forming shells 1800 and 1810 by snap-fastening, as shown diagrammatically in FIG. 17.

The support bodies of electrically insulating material 1100 and 1110 are essentially constituted by rectangular blocks of right section complementary to the right section of the cells defined by the partitions 1334, 1335 and the tabs 1336 and 1337, and to the cells defined by the central portion 1310. They extend over the length of the central portion 1310 and of the above-mentioned cells defined by the partitions 1334, 1335 and the tabs 1336 and 1337. Each of the bodies 1100 and 1110 is provided with two longitudinal channels each receiving a female receptacle 1200, 1210, 1220, and 1230.

The support bodies of electrically insulating material 1120 and 1130 are essentially constituted by rectangular blocks of right section complementary to the section of the cells defined by the central portion 1310. They extend over the length of said central portion 1310. Each of these bodies 1120 and 1130 is provided with two longitudinal channels each of which receives a male pin 1240, 1250, 1260, or 1270.

The support bodies 1140, 1150, 1160, and 1170 respectively extend the support bodies 1100, 1110, 1120, and 1130. Each of them possesses two channels that are open laterally towards the outside of the connector to receive a pair of contacts 1200 to 1270 and to enable conductors to be engaged on said contacts by means of the respective inserters 1400 to 1430.

To this end, each contact 1200 to 1270 is provided on its rear end that is accessible via the channels of the support body 1140 to 1170 with an insulation-displacing contact fork, as can be seen in FIG. 17.

Where appropriate, the support bodies 1140, 1150, 1160, and 1170 can be integrally formed respectively with the support bodies 1100, 1110, 1120, and 1130.

Naturally, the present invention is not limited to the embodiments described above, but extends to any variant within the spirit of the invention.

Thus, for example, in the embodiment shown in FIGS. 17 and 18, it is possible to invert the disposition of the female receptacles 1200–1230 and of the male pins 1240–1270, by placing the male pins 1240–1270 in the cells defined by the partitions 1334, 1335 and the tabs 1336, 1337, while placing the female receptacles 1200–1230 in the cells defined by the partition 1332.

What is claimed is:

1. An electrical connector for high frequencies, the connector comprising:

two elements (100, 200; 1000) adapted to be engaged by moving in translation, each element (100, 200; 1000) comprising a body (110, 210; 1100–1170) of electrically insulating material provided with electromagnetic shielding (130, 230; 1300) and carrying a plurality of electrical contacts (120–127; 220–227; 1200–1270), wherein the shielding (130, 230; 1300) of each element comprises a cage-forming portion (132, 232; 1310, 1330) provided with an internal crosspiece (135, 235) defining cells each housing a pair of contacts (120–127; 220–227; 1200–1270), and wherein the shielding crosspiece (135, 235) define a single electromagnetic join plane that is perpendicular to the axis of the connector.

2. A connector according to claim 1, characterized by the fact that each element (100, 200; 1000) has eight electrically conductive contacts (120–127; 220–227; 1200–1270).

3. A connector according to claim 1, characterized by the fact that each element (100, 200) possesses a cable clamp (150, 250) associated with a clamping ring (160, 260).

4. A connector according to claim 1, characterized by the fact that each element (100, 200; 1000) possesses four inserters (140, 240, 1400–1430).

5. A connector according to claim 1, characterized by the fact that each crosspiece (135, 235) is rearwardly extended by a central tail (138, 238) adapted to come into contact with an individual shields of a conductor pairs taken from a cable.

6. A connector according to claim 1, characterized by the fact that the shielding cage (132) of one of the elements (100) is adapted to receive the shielding cage (232) of the other element (200).

7. A connector according to claim 1, characterized by the fact that the crosspieces (135, 235) extend over different lengths inside their respective cages (132, 232) such that the crosspieces (135, 235) are end to end after the cages (132, 232) have been mutually engaged.

8. A connector according to claim 1, characterized by the fact that each cage includes an outlet face, one of the crosspieces (135) is set back in its cage (132) and terminates level with a step (131) formed in said cage while the other crosspiece (235) extends to the outlet face of its cage (232).

9. A connector according to claim 1, characterized by the fact that the body (110, 210) of each element (100, 200; 1000) defines four beams (112–115; 212–215; 1100–1130), of rectangular section, which beams are parallel and equidistant in pairs, each of which carries two contacts (120–127; 220–227, 1200–1270).

10. A connector according to claim 9, characterized by the fact that the beams (112–115) of a receptable-forming one of the elements (100) are each extended rearwards by respective plates (110) through which the contacts (120–127) pass.

11. A connector according to claim 9, characterized by the fact that the beams (112–115) of a receptable-forming element (100) are remote from a mid wall (136) of the shielding crosspiece (135) while the beams (212–215) of a plug-forming element (200) are adjacent to the wall (236) of the corresponding shielding crosspiece (235).

12. A connector according to claim 9, characterized by the fact that each beam includes an outer face and an opposite inner face facing the internal crosspiece and wherein in a receptable-forming element (100), the contacts (120–127) are provided on the inner faces of the beams (112–115) while in a plug-forming element (200) the contacts (220–227) are formed on the outer faces of the beams (212–215).

13. An electrical connector for high frequencies, the connector comprising:

two elements (100, 200; 1000) adapted to be engaged by moving in translation in a direction, each element (100, 200; 1000) comprising a body (110, 210; 1100–1170) of electrically insulating material provided with electromagnetic shielding (130, 230; 1300) and carrying a plurality of electrical contacts (120–127; 220–227; 1200–1270), wherein the shielding (130, 230; 1300) of each element comprises a cage-forming portion (132, 232; 1310, 1330) provided with an internal crosspiece (135, 235) defining cells each housing a pair of contacts (120–127; 220–227; 1200–1270), and said shielding (130, 230; 1300) forming, when in the assembled position, an electromagnetic join plane extending generally transversely to the direction in which the connector elements (100, 200; 1000) are mutually engaged, and wherein the body (110, 210) of each element (100, 200; 1000) defines four beams (112–115; 212–215; 1100–1130), of rectangular section, which beams are parallel and equidistant in pairs, each of which carries two contacts (120–127; 220–227; 1200–1270) and the beams (112–115) of a receptable-forming element (100) are remote from a mid wall (136) of the shielding crosspiece (135) while the beams (212–215) of a plug-forming element (200) are adjacent to the wall (236) of the corresponding shielding crosspiece (235).

14. An electrical connector for high frequencies, the connector comprising:

two elements (100, 200; 1000) adapted to be engaged by moving in translation in a direction, each element (100, 200; 1000) comprising a body (110, 210; 1100–1170)

of electrically insulating material provided with electromagnetic shielding (130, 230; 1300) and carrying a plurality of electrical contacts (120–127; 220–227; 1200–1270), wherein the shielding (130,230; 1300) of each element comprises a cage-forming portion (132, 232; 1310; 1330) provided with an internal crosspiece (135, 235) defining cells each housing a pair of contacts (120–127; 220–227; 1200–1270), and said shielding (130, 230; 1300) forming, when in the assembled position, an electromagnetic join plane extending generally transversely to the direction in which the connector elements (100, 200; 1000) are mutually engaged and wherein front ends of the crosspiece (135, 235) defining the electromagnetic join planes are serrated.

15. An electrical connector for high frequencies, the connector comprising:

two elements (100, 200; 1000) adapted to be engaged by moving in translation in a direction, each element (100, 200; 1000) comprising a body (110, 210; 1100–1170) of electrically insulating material provided with electromagnetic shielding (130, 230; 1300) and carrying a plurality of electrical contacts (120–127; 220–227; 1200–1270), wherein the shielding (130,230; 1300) of each element comprises a cage-forming portion (132, 232; 1310; 1330) provided with an internal crosspiece (135, 235) defining cells each housing a pair of contacts (120–127; 220–227; 1200–1270), and said shielding (130, 230; 1300) forming, when in the assembled position, an electromagnetic join plane extending generally transversely to the direction in which the connector elements (100, 200; 1000) are mutually engaged and wherein each cage having an outlet face, one of the crosspieces (135) is set back in its cage (132) and terminates level with a step (131) formed in said cage, while the other crosspiece (235) extends to the outlet face of its cage (232).

16. An electrical connector for high frequencies, the connector comprising:

two elements (100, 200; 1000) adapted to be engaged by moving in translation in a direction, each element (100, 200; 1000) comprising a body (110, 210; 1100–1170) of electrically insulating material provided with electromagnetic shielding (130, 230; 1300) and carrying a plurality of electrical contacts (120–127; 220–227; 1200–1270), wherein the shielding (130, 230; 1300 of each element comprises a cage-forming portion (132, 232; 1310; 1330) provided with an internal crosspiece (135, 235) defining cells each housing a pair of contacts (120–127; 220–227; 1200–1270), the shielding cage (132) of one of the elements (100) is adapted to receive the shielding cage (232) of the other element (200), each cage has an outlet face, one of the crosspieces (135) is set back in its cage (132) and terminates level with a step (131) formed in said cage, while the other crosspiece (235) extends to the outlet face of its cage (232) so that the crosspieces (135, 235) extend over different lengths inside their respective cages (132, 232) such that the crosspieces (135, 235) are end to end after the cages (132, 232) have been mutually engaged, and said shielding (130, 230; 1300) forming, when in the assembled position, an electromagnetic join plane extending generally transversely to the direction in which the connector elements (100, 200; 1000) are mutually engaged.

17. An electrical connector for high frequencies, the connector comprising:

two elements (100, 200; 1000) adapted to be engaged by moving in translation in a direction, each element (100, 200; 1000) comprising a body (110, 210; 1100–1170) of electrically insulating material provided with electromagnetic shielding (130, 230; 1300) and carrying a plurality of electrical contacts (120–127; 220–227; 1200–1270), wherein the shielding (130,230; 1300) of the two elements form, when in the assembled position, an electromagnetic join plane extending transversely to the direction in which the connector elements (100, 200; 1000) are mutually engaged, the shielding (1300) of each element including a central portion (1310) that is shaped, to define four cells of identical rectangular section, each designed to receive a respective body (1100, 1110, 1120, 1130) of complementary section each carrying a pair of contacts (1200–1270), the central portion (1310) of the shielding extending forwards by sets of partitions (1330) adapted to interpenetrate with identical sets of partitions on a complementary hermaphrodite connector element, the sets of partitions (1330) comprising an E-shaped partition (1332) defining two cells for receiving respective pairs of male pins (1240 & 1250 and 1260 & 1270), and two U-shaped partitions (1334 and 1335) together with two tabs (1336, 1337) which define two cells designed to receive respective supports (1100, 1110) each carrying a pair of female pins (1210 & 1220 and 1230 & 1240) the outside surface of the E-shaped partition (1332) extending the outside surfaces of three of the walls of the central portion (1310), the said partition (1332) having thickness that is smaller than the thickness of the walls making up the central portion (1310) so as to define, in the connection zone of said partition (1332) on the central portion (1310) at the bottoms of the cells formed by said partition (1332), a step (1331) facing towards the front of the connector, inside the above-specified cells, and extending transversely to the direction in which the elements of the connector are mutually engaged, the U-shaped partitions (1334 and 1335) and the tabs (1336 and 1337) being of a thickness that is smaller than the thickness of the walls making up the central portion (1310) so as to define, in the connection zone of the U-shaped partitions (1334 and 1335) and of the tabs (1336 and 1337) on the central portion (1310), at the bottoms of the cells formed by the U-shaped partitions (1334 and 1335) and said tabs (1336 and 1337), a step (1338) facing towards the front of the connector, outside the above-mentioned cells, and transversely to the direction in which the connector elements are mutually engaged the right section of the structures defined by the U-shaped partitions (1334, 1335) and the tabs (1336 and 1337) being complementary to the right section of the cells defined by the E-shaped partition (1332), and the width of the step (1331) inside the E-shaped partition (1332) being identical to the thickness of the U-shaped partitions (1334, 1335) and the tabs (1336 and 1337), while the width of the step (1338) outside said partitions is identical to the thickness of the E-shaped partition (1332).

18. A connector according to claim 17, characterized by the fact that the central portion (1310) is extended rearwards by longitudinal sheets (1320) forming a pair of back-to-back E-shapes possessing a common web and defining four housings laterally open to the outside of the connector, designed to receive complementary contact-supporting bodies (1140, 1150, 1160 and 1170) and associated inserters (1400, 1410, 1420 and 1430).

* * * * *